United States Patent [19]

Li

[11] 4,420,956

[45] Dec. 20, 1983

[54] COMBINATION LOCK

[75] Inventor: Sze Y. Li, Kowloon, Hong Kong

[73] Assignee: Kwoon Kwen Metal Ware Company Ltd., Kowloon, Hong Kong

[21] Appl. No.: 251,690

[22] Filed: Apr. 6, 1981

[30] Foreign Application Priority Data

Apr. 9, 1980 [GB] United Kingdom ..... 8011671

[51] Int. Cl.[2] ..... E05B 37/02; E05B 65/52

[52] U.S. Cl. ..... 70/312; 70/71; 70/318

[58] Field of Search ..... 70/312, 318, 69–71

[56] References Cited

U.S. PATENT DOCUMENTS

| | | | |
|---|---|---|---|
| 2,160,698 | 5/1939 | Herbst | 70/312 |
| 3,266,275 | 8/1966 | Atkinson | 70/70 |
| 3,392,556 | 7/1968 | Atkinson | 70/71 |
| 3,459,016 | 8/1969 | Atkinson | 70/312 |
| 3,766,760 | 10/1973 | Mohrhauser et al. | 70/312 X |

FOREIGN PATENT DOCUMENTS

| | | | |
|---|---|---|---|
| 2659186 | 7/1978 | France | 70/312 |
| 2807975 | 8/1979 | France | 70/312 |
| 2030208 | 4/1980 | United Kingdom | 70/312 |
| 2067649 | 7/1981 | United Kingdom | 70/312 |

*Primary Examiner*—Cornelius J. Husar
*Assistant Examiner*—Lloyd A. Gall
*Attorney, Agent, or Firm*—Lawrence Rosen

[57] ABSTRACT

A combination lock for personal luggage such as a suitcase or briefcase comprising a pivotably mounted latch member capable, when in a latched condition, of securing a cooperating tongue member and a bolt for locking the latch member in its latched position, the bolt being spring biassed to a release position and so moved to the release position when projections from the bolt can engage in respective recesses in cams, which cams are each individually rotatable by and with a respective one of a plurality of wheels manually indexable around and bearing visible markings. The cams are normally interlocked for rotation each with its respective wheel but the interlocking can be released to enable the combination of the lock to be changed.

2 Claims, 9 Drawing Figures

FIG.1.
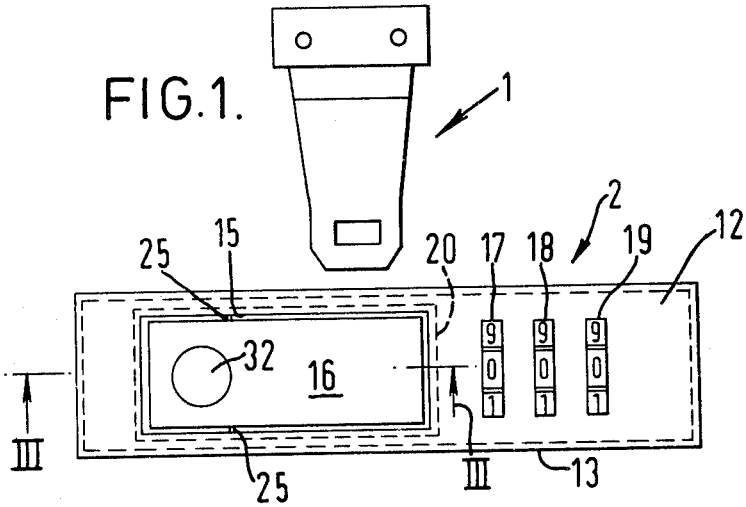
FIG.2.
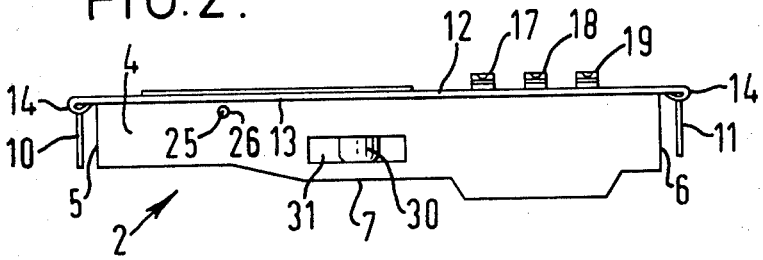
FIG. 4.
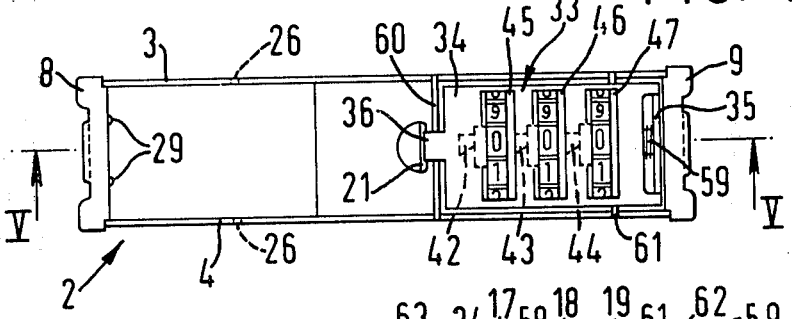
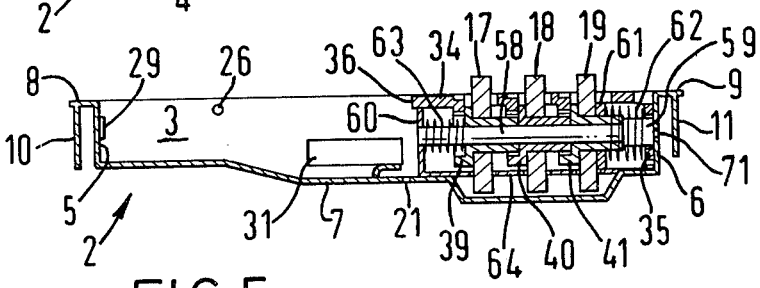
FIG.5.

COMBINATION LOCK

The invention relates to a combination lock and particularly, though not exclusively, to such a lock for personal luggage such as a suitcase or briefcase.

The invention has among its objects to provide a combination lock which is neat and compact with only a few components, which components can be easily manufactured as simple stampings and pressings or as simple turned parts.

According to the invention a combination lock comprises a pivotably mounted latch member capable, when in a latched condition, of securing a cooperating tongue member and bolt means for locking the latch member in its latched position, the bolt means being spring biassed to a release position and so moved to the release position when projections from the bolt can engage in respective recesses in cams, which cams are each individually rotatable by and with a respective one of a plurality of wheels manually indexable around and bearing visible markings.

The pivotably mounted latch member can be mounted in a housing securable, for example, to the body of a case and the cooperating tongue member can be secured to the lid of the case so that when in the latched and locked condition the combination lock prevents unauthorised opening of the case.

Preferably, the tongue member engages in the housing internally of the case so as not to be visible when the lid of the case is closed.

When the wheels, preferably three wheels, are rotated to determined positions of rotation as indicated by the markings thereon, the projections from the bolt can enter the recesses in the cams to allow the bolt to move to the release position. In all other rotational positions of the wheels and cams the bolt is pressed by the cams into the locked position in which it prevents the pivotably mounted latch pivoting to an unlatched position and thus retains the cooperating tongue member against movement away from the pivotably mounted latch.

Advantageously, the wheels and the respective cams are normally interlocked for rotation together, but such interlocking can be released to allow alteration of the rotational position of each individual wheel relative to its respective cam to change the combination of the lock.

Preferably the cams are in the form of stepped cylindrical bushes rotatable on a mounting pin, the recess in each bush to receive one of the projections from the bolt being provided in the larger diameter portion thereof. The respective wheel is rotatable, to change the combination of the lock, on the smaller diameter position thereof. At least one projection is provided, to effect said inter-locking of the cam and the respective wheel, projecting from the bush at the position of the step thereon between the two portions of different diameter.

The mounting pin on which the bushes are mounted is preferably axially spring biassed and the bushes can be moved axially by axial movement of the pin against the bias of the spring while the wheels are prevented from moving axially, thereby to release said interlocking.

The bolt preferably comprises an angled plate member having a first limb with a projection at its free end to engage the pivotably mounted latch, slots in said first limb through which slot portions of the wheels can project with lateral clearance and depressed portions in said first limb forming said projections to cooperate with the recesses in the cams, and a second limb at right angles to said first limb and having an aperture therein through which said mounting pin projects, movement of said bolt between its locking and release positions causing said first limb to move in the plane of said first limb and parallel to said pin. The spring providing the bias of the bolt to the release position is preferably a coil spring which surrounds said pin and presses against the second limb of the angled plate member.

The invention is diagrammatically illustrated by way of example in the accompanying drawings, in which:

FIG. 1 is a plan view of a combination lock according to the invention;

FIG. 2 is an elevation of the lock of FIG. 1;

FIG. 4 is a view corresponding to FIG. 1 but showing the lock after the top cover plate has been removed;

FIG. 5 is a sectional view on line V—V of FIG. 4;

Figure 3:
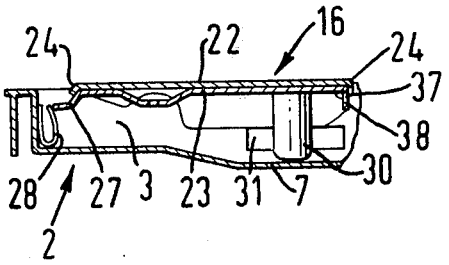
FIG. 3 is a fragmentary sectional view on line III—III of FIG. 1 but not showing a top cover plate.

Referring to the drawings, a combination lock comprises a tongue member 1 which cooperates with a lock mechanism within a housing 2. The housing 2 is trough-shaped with side walls 3 and 4, end walls 5 and 6 and a bottom wall 7 which at its right-hand end as viewed in the drawings is of part cylindrical form. Flanges 8 and 9, extend outwardly at the upper edges of the end walls 5 and 6 and securing lugs 10 and 11 extend downwardly from middle portions of the flanges 8 and 9. A top cover plate 12 has a down-turned peripheral flange 13 and is provided at its ends with lugs 14 which are bent around to engage beneath side portions of the flanges 8 and 9 of the housing 2 to secure the top cover plate 12 to the housing 2.

The top cover plate 12 has a rectangular slot 15 therein through which projects the top of a pivotable latch 16 and three further slots through which project portions of the peripheries of three setting wheels 17, 18 and 19. Around the edge of the slot 15 is a downturned flange which, at the righthand end of the slot 15, is formed as a tongue 20 which projects through a slot 21 in the bottom wall 7 of the housing 2 and is bent over within an adjacent recesses as a further securing lug. The pivotable latch 16 has a top plate 22 and a lower plate 23, secured together by bent over lugs 24. The lower plate 23 has sidewardly projecting trunnions 25 engaging in apertures 26 in the side walls 3, 4 thereby pivotably to mount the latch 16 in the housing 2 and a leftwardly projecting tongue 27 which cooperates with a U-shaped spring 28, located against the end wall 5 by projections 2a, to give pivotable movement of the latch 16 a snap action. The lower plate 23 also has two downwardly projecting latch members 30, each of which, in the latched position shown, lies adjacent a respective aperture 31 in the adjacent side wall 3, 4. The tongue member 1 has an aperture therein and can be inserted through one or other of the apertures 31 when the latch 16 is in its unlatched position, the respective latch member 30 engaging in the aperture in the tongue member 1 when the pivotable latch 16 is moved to its latched position thereby to secure the tongue member 1 against removal from the housing 2.

In use, a rectangular aperture large enough to receive the housing 2 is provided in a wall of the body of a container, such as a briefcase or suitcase. The housing 2 is inserted therein from the outside until the edge of the peripheral flange 13 of the top cover plate 12 lies against the wall of the case and the securing lugs 10, 11 are then bent outwardly to lie against the inner wall of the case to secure the housing 2 in position. The tongue member 1 is secured to the lid of the case in a position such that it will engage in one of the apertures 31 when the lid is closed, thereby to secure the lid against opening when the latch 16 is moved to its latched position to secure the tongue member 1 in the housing 2. The tongue member 1 will be totally within the case and not visible from the outside and thus cannot be forced out of the housing 2 by an unauthorised person applying a lever thereto.

The pivotable latch 16 is moved to its unlatched position by pressing on the portion thereof marked with a circle 32 in FIG. 1.

Figure 6:
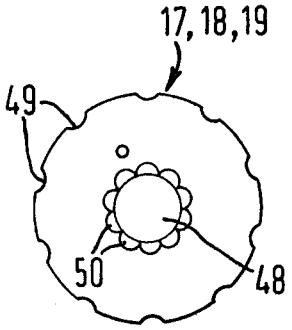
FIG. 6 shows to a greater scale a wheel of the lock of FIGS. 1 to 5.

To lock the latch 16 against movement to its unlatched position, a bolt 33 is provided. The bolt 33 is formed as an angled plate having a top limb 34 and a downwardly depending limb 35 at right angles thereto. At its left hand end the top limb 34 has a tab 36 which projects through an aperture in the tongue 20 and can engage in an aperture 37 in a downturned flange 38 at the right hand end of the lower plate 23 of the latch 16. The bolt 33 is shown in its unlocked position in FIGS. 4 and 5 and moves leftwardly from that position to effect locking. Such movement is controlled by three cams 39, 40, 41, each individually rotatable by a respective one of the wheels 17, 18, 19 and cooperating with cam followers 42, 43, 44 provided as depressed portions of the top limb 34 of the bolt 33 adjacent slots 45, 46, 47 therein; through which slots the wheels 17, 18, 19 project with considerable lateral clearance. The wheels 17, 18, 19 are identical and, as shown in FIG. 6, each has a central aperture 48, ten depressions 49 in the outer periphery and ten recesses 50 in one side face adjacent the aperture 48, each radially aligned with a respective one of the depressions 49. Markings 0 to 9 are provided between the depression 49 in the outer periphery.

Figure 7:
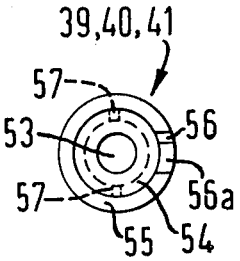
FIGS. 7 and 8 show to a greater scale an end view and a side view, respectively, of a wheel mounting bush.
Figure 8:
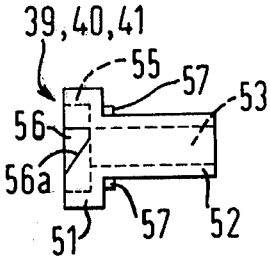

The cams 39, 40, 41 are identical and, as shown in FIGS. 7 and 8, each comprise a stepped cylindrical bush having a large diameter portion 51, a small diameter portion 52, a central bore 53, a counter-bore 54 in the portion 51 to form a rim 55, a cut-away 56 with an inclined face **56*a* in the rim 55 and two locating projections 57 at the position of the shoulder between the portions 51 and 52. When the smaller diameter portion 52 of the cam is engaged in the central aperture 48 of the wheel from the side of the wheel shown in FIG. 6, the locating projections 57 will locate in two of the recesses 50** to secure the wheel and cam against relative rotation.

Figure 9:
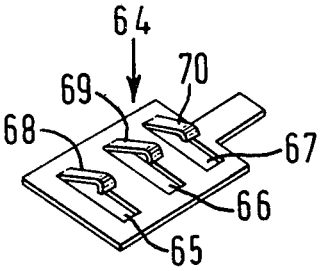
FIG. 9 shows a spring plate.

As shown in FIG. 5, the wheels 17, 18, 19, each mounted on its respective cam 39, 40, 41 are located on a pin 58 having a head 59, the smaller diameter portions of the cams 39 and 40 engaging in the counter-bores of the cams 40 and 41 respectively. The head 59 of the pin 58 is engaged in a bore in the limb 35 of the bolt 33 and the pin passes through bores in transverse plates 60 and 61 located at their edges in slots in the sidewalls 3, 4 of the housing 2. A coil spring 62 surrounds the head 59 of the pin 58 and extends between the plate 61 and the limb 35 of the bolt 33 to bias the bolt 33 rightwardly. A further coil spring 63 surrounds the pin 58 and extends between the plate 60 and the cam 39 to bias the cams 39, 40, 41 rightwardly. A spring plate 64, the underside of which is shown in FIG. 9, lies in the bottom of the housing 2, is dimensioned so that it is held against movement in the housing 2 by the plate 60, has three slots 65, 66, 67, through which the lower peripheries of the wheels 17, 18, 19 respectively pass with minimum lateral clearance, and three spring detents 68, 69, 70 with inturned ends to engage the depressions 49 in the wheels 17, 18, 19 to give a click-over feel to rotation of the wheels and to restrain the wheels against undesired rotation. The plate 60, the sidewalls 3 and 4 and the aperture in the limb 35 of the bolt 33 which receives the pin head 59, mount the top limb 34 of the bolt 33 for close sliding movement against the underside of the top cover plate 12.

In the relative positions shown in FIGS. 4 and 5, the cam follower projections of the bolt 33 formed by the depressions 42, 43, 44 are engaged in the cut-aways 56 of the respective cams 39, 40, 41 and the bolt 33 is thus in its rightward unlocked position. Rotation of any one of the wheels 17, 18, 19 from this position, in a direction to cause the upper part of the wheel to move upwardly as viewed in FIGS. 1 and 4, will rotate the respective cam 39, 40, 41 and the inclined face **56*a* of the cut-away 56 of the cam will cam the cam follower out of the cut-away to cause the bolt 33 to move leftwardly to engage the tab 36 thereof in the aperture 37 of the downturned flange 38 of the latch 16, thereby to secure the latch 16 against pivotal movement. The lock is thus locked and cannot be opened until all the wheels 17, 18, 19, have been rotated to a position in which all the cam followers formed by the depressions 42, 43, 44 have been re-aligned with the cut-aways 56 in the cams 39, 40, 41 and the bolt 33 has been moved rightwardly by the bias of the spring 62**.

To change the setting of the lock, i.e., the numbers on the wheels 17, 18, 19, which, when aligned in the positions shown by the numbers 000 in FIGS. 1 and 4, unlock the lock, a pointed tool is engaged in an aperture 71 in the end wall 6 of the housing 2 and the pin 58 is thereby pressed leftwardly against the bias of the spring 63. The head 59 of the pin 58 bears against the cam 41 and the cams 39, 40, 41 thus more leftwardly with the pin 58 but the wheels are restrained against such movement by the spring plate 64 and the top cover plate 12. The locating projections 57 on the cams are thus disengaged from the recesses 50 in the wheels and the wheels become freely rotatable on the smaller diameter portions 52 of the cams and can be rotated so that when the pin 58 is released and moves rightwardly under the bias of the spring 63, the cams and the respective wheels are in altered relative positions of rotation and the lock has an altered combination.

What is claimed is:

1. A combination lock comprising a housing; a tongue member; a latch member pivotably mounted in said housing for movement between a latched position and an unlatched position and capable, when in said latched position, of securing said tongue member against removal from said housing; bolt means for locking said latch member in said latched position; projections on said bolt means; a plurality of cams; a spring biassing said bolt means to a release position and so moved to said release position when said projections on said bolt means can engage in respective recesses in said cams; and a plurality of wheels each associated with a respective one of said plurality of cams, said wheels each being manually indexable around, bearing a visible marking and when indexed entraining for movement the respective one of said plurality of cams, whereby when each of said wheels is rotated to a respective determined position of rotation as indicated by said marking thereon, said projections from said bolt means can enter said recesses in said cams to allow said bolt means to move to said release position, but in all other rotational positions of said wheels and said cams, said bolt means is pressed by said cams into said locked position in which it prevents said pivotably mounted latch member pivoting to said unlatched position and thus retains said tongue member against movement away from said pivotably mounted latch out of said housing; wherein each of said cams is formed as a stepped cylindrical bush rotatable on a mounting pin, said recesses in said cams are provided as a respective recess in each said bush to receive a respective one of said projections from said bolt means and each said recess is provided in a larger diameter portion of said respective stepped bush, said respective wheel is rotatable, to change the combination of said lock, on a smaller diameter portion thereof and at least one projection is provided, to effect said inter-locking of said cam and said respective wheel, projecting from said bush at the position of the step thereon between said portions of different diameter; and wherein said bolt means comprises an angled plate member having a first limb with a projection at its free end to engage said pivotably mounted latch, slots are provided in said first limb through respective ones of which slots portions of said wheels can project with lateral clearance and depressed portions are provided in said first limb forming said projections to cooperate with said recesses in said cams, a second limb of said angled plate member extends at right angles to said first limb and has an aperture therein through which said mounting pin projects, and movement of said bolt means between its said locking and release positions causes said first limb to move in the plane of said first limb and parallel to said mounting pin.

2. A combination lock as claimed in claim 1, wherein said spring providing the bias of said bolt means to said release position is a coil spring which surrounds said mounting pin and presses against said second limb of said angled plate member.

* * * * *